United States Patent [19]

Tada

[11] 4,179,070

[45] Dec. 18, 1979

[54] SPRAYER

[76] Inventor: Tetsuya Tada, 6-3, 2-chome, Kakinokizaka, Meguro-ku, Tokyo, Japan

[21] Appl. No.: 853,535

[22] Filed: Nov. 21, 1977

[30] Foreign Application Priority Data

May 9, 1977 [JP] Japan ..... 52/52886
May 19, 1977 [JP] Japan ..... 52/64321[U]

[51] Int. Cl.[2] ..... B05B 9/04
[52] U.S. Cl. ..... 239/333; 222/321
[58] Field of Search ..... 239/331, 333, 321, 350; 222/340, 385, 321, 383

[56] References Cited

U.S. PATENT DOCUMENTS

| | | | |
|---|---|---|---|
| 3,471,065 | 10/1969 | Malone | 239/333 |
| 3,921,861 | 11/1975 | Kondo | 239/333 |
| 3,957,178 | 5/1976 | Steiman | 222/321 |
| 4,050,613 | 9/1977 | Corsette | 239/333 |
| 4,061,250 | 12/1977 | Tada | 239/333 |

*Primary Examiner*—James B. Marbert
*Attorney, Agent, or Firm*—Frishauf, Holtz, Goodman and Woodward

[57] ABSTRACT

A sprayer wherein there is formed in a sprayer body a pressurizing cylinder defining a pressurizing chamber communicating with a pressure accumulating chamber defined by a pressurizing cylinder in which a valve rod is slidably received. The pressurizing cylinder has a smaller diameter than the pressure accumulating cylinder. A piston is slidably inserted into the pressurizing cylinder. When liquid received in the pressurizing chamber is pressurized by bringing down the piston in the smaller diameter pressurizing cylinder, then a higher pressure than the pressing force of the piston is applied by Pascal's principle to the valve rod against the urging force of a pressure accumulating spring disposed behind the valve rod, because the valve rod has a larger diameter than the piston. When the high pressure is applied to the pressure accumulating spring, then a highly pressurized liquid can be sprayed, though the piston itself applies a relatively low pressing force. Since the pressure accumulating spring is received in the larger diameter pressure accumulating cylinder, a spring having a large pressure accumulating capacity can be used.

7 Claims, 1 Drawing Figure

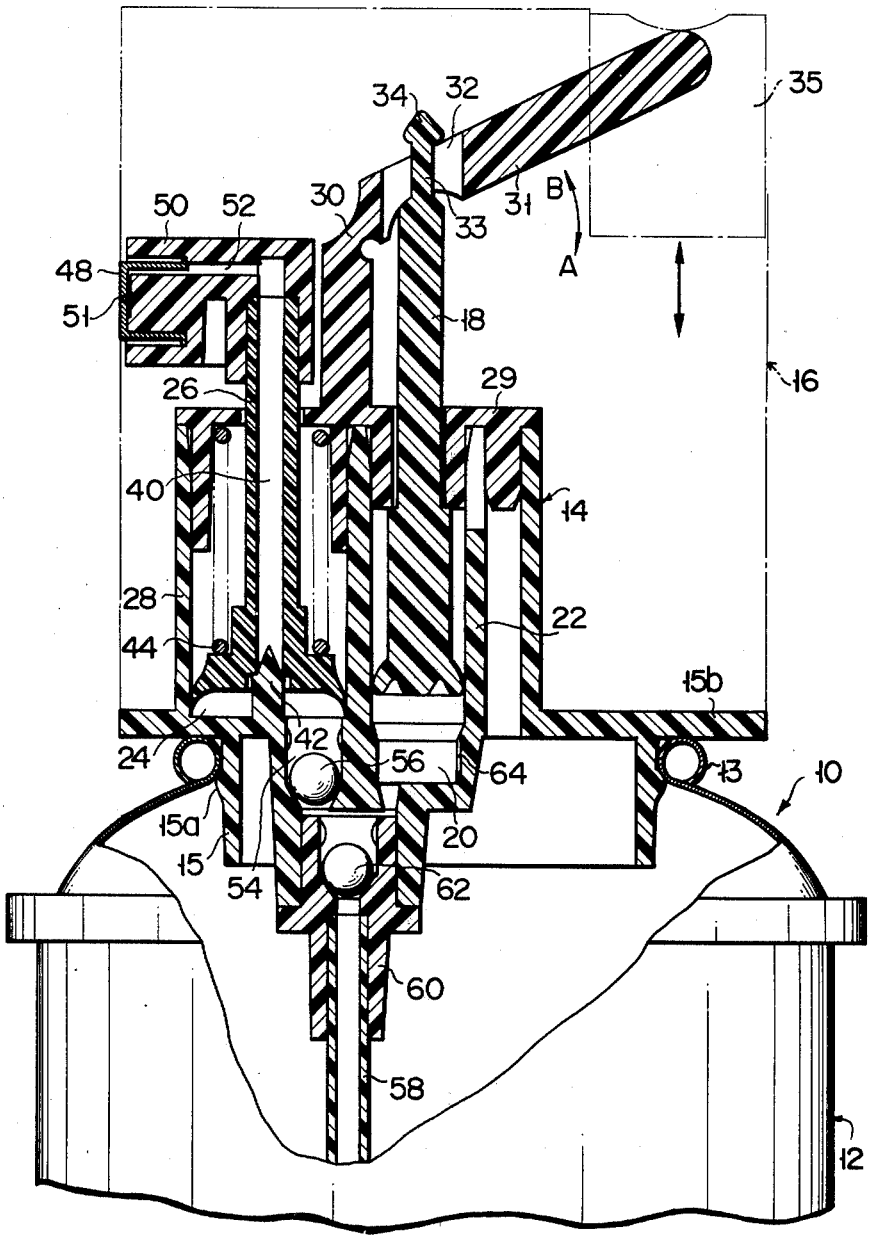
34
32
35
50
52
30
31
B
33
A
48
51
18
16
26
29
40
14
28
22
44
15b
24
42
56
64
13
10
15a
20
15
54
62
60
58
12

SPRAYER

BACKGROUND OF THE INVENTION

This invention relates to a sprayer which is designed to suck a liquid received in a container into a cylinder by the slide of a piston and spray the liquid under pressure.

With this type of sprayer, the pressing force of a piston and the speed at which the piston is let to fall exert a prominent effect on the condition in which a liquid is sprayed. Where the piston has an insufficient pressing force or is brought down at a low speed, then, a satisfactory spray can not be realized due to a liquid being scattered in coarse particles, droplets, or bar-like form. Further, under the above-mentioned undesirable condition, the same event arises due to pressure drop also when the spraying operation is brought to an end.

For elimination of such drawbacks, there have hitherto been proposed a variety of pressure accumulating type sprayers, which are designed to accumulate a pressing force derived from the descent of a piston in the form of the urging force of compression spring, and, when the urging force exceeds the prescribed level, to open a secondary valve, thereby spraying a highly pressurized liquid. The known sprayers of the above-mentioned type include, for example, an atomizing pump set forth in U.S. Pat. No. 3,399,836 allowed to Fred Pechstein. Fred Pechstein's atomizing pump comprises a cylinder of a larger diameter in which a piston is slidably received and a cylinder of a smaller diameter in which a plunger or valve rod is slidably received, both cylinders being arranged in series. With the atomizing pump of the U.S. Patent, a piston is brought down to pressurize a liquid. When the pressurized liquid is permitted to flow from the cylinder of the larger diameter into that of the smaller diameter, a valve rod falls at a higher speed than that at which the piston is brought down. Thus, the pressurized liquid is sprayed when a secondary valve is opened. A pressure accumulating spring is received in the cylinder of the smaller diameter behind the valve rod so as to be actuated against the force with which the valve rods descends. Many of the prior art pressure accumulating type sprayers utilize the technical concept of the above-mentioned Fred Pechstein's atomizing pump. However, the conventional sprayers based on Fred Pechstein's technical concept are inevitably accompanied with the drawbacks that since the pressurization of a liquid is effected by causing the piston to slide through the cylinder of the larger diameter to apply pressure to the valve rod received in the cylinder of the smaller diameter, the valve rod receives a lower pressure than the pressing force of the piston, failing to allow the pressure accumulate spring to accumulating a sufficiently high pressure. Since the pressure accumulating spring is disposed in a chamber of a smaller diameter, a spring having a large capacity of accumulating pressure can not be utilized for accumulation of pressure. The spray of a liquid can not be commenced at a high pressure and the liquid fails to be sprayed at a fully high pressure, because the pressure accumulating spring does not apply a sufficiently high pressure to the liquid while it is being sprayed.

It is therefore an object of this invention to provide a novel sprayer based on a technical concept entirely different from that of Fred Pechstein and which always enables a liquid to be sprayed under good condition.

SUMMARY OF THE INVENTION

According to the present invention, a sprayer has a body which comprises a piston slidably received in the body; a pressurizing cylinder for defining a liquid receiving pressurizing chamber together with the piston; a valve rod slidably received in the body; a pressure accumulating cylinder for defining a liquid receiving pressure accumulating chamber together with the valve rod; nozzle means having an ejection hole communicating with the pressure accumulating chamber; and biasing means disposed in the pressure accumulating cylinder to bias the valve rod. The sprayer is characterized in that the pressurizing cylinder and the pressure accumulating cylinder are arranged substantially in parallel; the pressure accumulating chamber has a larger diameter than the diameter of the pressurizing chamber; and the sprayer body further comprises a lever rotatable about a pivotal point lying substantially between the pressurizing and pressure accumulating cylinders; a vertically movable push button disposed adjacent to and substantially in parallel with the pressurizing cylinder and drivingly connected to the free end of the lever, and a stationary check valve coupled between the pressurizing chamber and the pressure accumulating chamber for communicating the chambers with each other and for preventing liquid from flowing backward from the pressure accumulating chamber to the pressurizing chamber.

The above and further objects and novel features of the invention will be more fully apparent from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWING

The accompanying drawing is a schematic fractional longitudinal sectional view of a sprayer according to one preferred embodiment of this invention.

DETAILED DESCRIPTION

Referring to the drawing showing the schematic fractional longitudinal sectional view of a push button type sprayer based on the technical concept of this invention, a sprayer 10 comprises a container 12 filled with a liquid; a body 14 of a pump or sprayer securely engaged with a mouthpiece 13 of the container 12 by an engagement member 15 whose outer peripheral surface is tapered, the edge of the mouthpiece 13 having a circular cross section; and a housing 16 so disposed as to cover the sprayer body 14. For simplification of illustration, the drawing shows a sprayer from which the housing 16 is taken off. The engagement member 15 of the sprayer body 14 whose outer peripheral surface is tapered can be smoothly engaged with the rounded edge of the mouthpiece 13 of the container 12, and moreover is securely set in place by the elasticity of the rounded edge portion of the mouthpiece 13. If, in this case, the tapered outer peripheral surface of the engagement member 15 is provided with a rounded projection **15*a*, then the engagement member 15 can be more firmly clamped between the rounded projection 15*a* and a flange 15*b* of the sprayer body 14. The sprayer body 14 comprises a slidably received piston 18 and pressurizing cylinder 22 both defining a pressurizing chamber 20, and also a valve rod 26** and pressure accumulating cylinder 28 both defining a pressure accumulating chamber 24 communicating with the pressurizing chamber 20. The pressurizing cylinder 22 and pressure accumulating cylinder 28 are arranged in parallel. A cover 29 is engaged with the upper end of the sprayer body 14 to close the openings of both cylinders 22, 28. A lever 31 is integrally formed with the cover 29 in a state rotatable about a hinge 30, and is bored with an elongate hole 32, through which the piston 18 is connected to the lever 31. The smaller diameter section 33 of the piston 18 is loosely inserted into the smaller diameter section of the elongate hole 32. The terminal larger diameter section 34 of the piston 18 passes through the smaller diameter section of the elongate hole 32 when pressure is applied. The larger diameter section of the elongate hole 32 admits of the relative crosswise sway of the smaller diameter section 33 of the piston 18 when the piston 18 slides substantially in a vertical direction per rotation of the lever 31 about the hinge 30. The free end of the lever 31 is drivingly connected to a push button 35 slidably provided in the housing 16. The cover 29 is prepared from plastics material such as acetal resin which excels in durability and particularly in elasticity. The push button 35 is normally set in a lifted position by the elasticity of the lever 31, that is, in such a position as corresponds to the nonrotated position of the lever 31. As the result, the piston 18 is normally kept in a lifted position, making it unnecessary to provide any extra spring for urging the piston 18 to the lifted position. Since the pressurizing cylinder 20 need not be made long, the sprayer body 14 can be injection-molded quickly. Further, the hinge 30 lies between the pressurizing chamber 20 and presssure accumulating chamber 24 and adjacent to the piston 18. Therefore, the piston 18 is depressed with a force several times as large as that with which the push button 35 is depressed by the finger.

The valve rod 26 received in the pressure accumulating cylinder 28 of the larger diameter has a vertical liquid passageway 40. Received in the pressure accumulating cylinder 28 is a compression spring 44 for urging the valve rod 26 toward the valve seat 42 to cause the liquid passageway 40 to be closed by the valve seat 42. The upper end of the valve rod 26 is connected to nozzle means 50 engaged with a nozzle cover 48. An ejection hole 51 bored in the nozzle cover 48 communicates with the vertical liquid passageway 40 through a horizontal liquid passageway 52.

The pressure accumulating chamber 24 of the larger diameter communicates with the pressurizing chamber 20 of the smaller diameter through a connector path 54. A ball valve 56 is provided in the connector path 54 to act as a secondary backward flow-stopping valve for shutting off communication between both chambers 20, 24. A cylindrical member 60 for fitting a suction pipe 58 is engaged with the sprayer body 14 on that side of the ball valve 56 which faces the pressurizing chamber 20. A primary backward flow-stopping ball valve 62 is received in the cylindrical member 60. That section of the inner wall of the pressurizing cylinder 22 which lies adjacent to the lowermost position of the piston 18 has a smaller diameter. The smaller diameter wall is bored with slits 64 to conduct the residual pressure in the pressurizing chamber 20 into the liquid container 12.

There will now be described the operation of the sprayer of this invention constructed as described above. When the push button 35 is depressed the lever 31 is rotated about the hinge 30 against its own elastic force in the direction of an arrow A . Rotation of the lever 31 leads to the fall of the piston 18, causing the air pressurized in the pressurizing chamber 20 to be brought into the pressure accumulating chamber 24 through the ball valve 56 now opened by the pressurized air. At this time, the other ball valve 62 is pressed against the valve seat by the pressurized air. Later when the push button 35 is released from fingers pressure, then the lever 31 is rotated about the hinge 30 in the direction of an arrow B. This rotation of the lever 31 leads to the rise of the piston 18, giving rise to a negative pressure in the pressurizing chamber 20. Accordingly, the liquid of the container 12 flows into the pressurizing chamber 20 through the suction pipe 58 and ball valve 56 in turn. Since, at this time, the ball valve 56 is pressed against the valve seat, the air of the pressure accumulating chamber 24 is fully prevented from its backward flow to the pressurizing chamber 20. When the piston 18 is brought downward by again depressing the push button 35 by the finger, then the residual air in the pressurizing chamber 20 and incoming liquid run into the pressure accumulating chamber 24 through the ball valve 56 opened by the flowing air and liquid.

Where positive and negative pressures are repeatedly applied to the pressurizing chamber 20 by operation of the piston 18, then air in the pressurizing chamber 20 is all gathered into the pressure accumulating chamber 24. Where pressure applied to the valve rod 26 of the pressure accumulating chamber 24 increases over the urging force of the compression spring 44, then the valve rod 26 is lifted against the urging force. The resultant removal of the valve rod 26 from the valve seat 42 causes the liquid passageway 40 to communicate with the pressure accumulating chamber 24. As the result, pressurized air in the pressure accumulating chamber 24 is drawn out from the ejection hole 51 through the liquid passageways 40, 52.

Actual spray immediately follows the removal of air from the pressurizing chamber 20 and pressure accumulating chamber 24. When, as in the discharge of air, the push button 35 is depressed by the finger, then the lever 31 is rotated in the direction of the arrow A, to let fall the piston 18. Descent of the piston 18 pressurizes the liquid of the pressurizing chamber 20. The pressurized liquid is carried into the pressure accumulating chamber 24 through the ball valve 56 now opened by the pressurized liquid. When the push button 35 is released from finger pressure to lift the piston 18 and provide a negative pressure in the pressurizing chamber 20, then the liquid of the container 12 runs into the pressurizing chamber 20 through the suction pipe 58 and ball valve 62 in turn. Since, at this time, the ball valve 56 is passed against the valve seat by the negative pressure in the pressurizing chamber 20 and the pressurized liquid in the pressure accumulating chamber 24, communication does not take place between the pressurizing chamber 20 and pressure accumulating chamber 24. Therefore, the pressurized liquid in the pressure accumulating chamber 24 is kept therein. Later when the push button 35 is depressed by the finger to bring down the piston 18 and pressurize the liquid of the pressurizing chamber 20, then the pressurized liquid flows into the pressure accumulating chamber 24 through the ball valve 56, thereby applying further pressure to the liquid of the pressure accumulating chamber 24.

When the pressurized liquid of the pressurizing chamber 20 is repeatedly supplied to the pressure accumulating chamber 24 by the repeated fall of the piston 18, then the pressurized liquid of the pressure accumulating chamber 24 is more pressurized. Since the pressure accumulating chamber 24 has a larger diameter than the pressurizing chamber 20, high pressure is applied to the pressure accumulating chamber 24 by Pascal's principle, and in consequence to the valve rod 26. Where the liguid of the pressure accumulating chamber 24 is fully pressurized, and pressure applied to the valve rod 26 overcomes the urging force of the pressure accumulating spring 44, then the valve rod 26 is detached from the valve seat 42, and the fluid passageway 40 of the valve rod 26 communicates with the pressure accumulating chamber 24. As the result, highly pressurized liquid is sprayed from the ejection hole 51 through the pressure accumulating chamber 24 and liquid passageways 40, 52.

According to this invention, the piston is made to slide through the pressurizing chamber of the smaller diameter to apply high pressure to the valve rod of the pressure accumulating chamber, and in consequence to the pressure accumulating spring disposed behind the valve rod. Further, the pressure accumulating spring received in the pressure accumulating chamber of the larger diameter is used with a large pressure accumulating capacity, enabling a liquid to be sprayed at high pressure from the beginning to the end.

It is preferred that the secondary backward flow-stopping valve be provided between the pressurizing chamber and the pressure accumulating chamber to suppress the backward flow of a liquid from the pressure accumulating chamber to the pressurizing chamber. This backward flow-stopping valve enables the pressurized liquid conducted from the pressurizing chamber to the pressure accumulating chamber to be completely separated from the nonpressurized liquid running into the pressurizing chamber by its negative pressure. Repeated supply of pressurized liquid to the pressure accumulating chamber causes the liquid received therein progressively to increase in pressure. Only when fully pressurized, the liquid begins to be sprayed.

It will be noted that all the pressurized liquid of the pressurizing chamber is not sprayed when the piston is brought down. But some of the pressurized liquid remains in the pressure accumulating chamber. The residual pressure of the remaining liquid undesirably tends to prevent the occurrence of a negative pressure in the pressurizing chamber when the piston is lifted. Since, however, the inner wall of the pressurizing chamber is bored with slits, the above-mentioned residual pressure escapes into the container through the slits, and consequently the negative pressure of the pressurizing chamber is not obstructed. The slits are formed in the peripheral wall of the pressurizing chamber at an equal circumferential angle, causing the whole of a seal strip of the piston to be uniformly deformed. Therefore, the piston can slide over a long period in liquidtightness without giving rise to fissures in the piston seal strip.

The accompanying drawing showing the preferred embodiment of the invention is simply for illustration of the technical concept of the invention. Obviously, the technical concept of the invention is applicable to a sprayer of not only the push button type but also the trigger type.

What is claimed is:

1. In a sprayer having a body which comprises a piston slidably received in the body; a pressurizing cylinder for defining a liquid receiving pressurized chamber together with the piston; a valve rod slidably received in the body; a pressure accumulating cylinder for defining a liquid receiving pressure accumulating chamber together with the valve rod; nozzle means having an ejection hole communicating with the pressure accumulating chamber; and biasing means disposed in the pressure accumulating cylinder to bias the valve rod;

the improvement wherein:

the pressurizing cylinder and the pressure accumulating cylinder are arranged substantially in parallel;

the pressure accumulating chamber has a larger diameter than the diameter of the pressurizing chamber; and the sprayer body further comprises a lever rotatable about a pivotable point lying substantially between the pressurizing and pressure accumulating cylinders; a vertically movable push button disposed adjacent to and substantially in parallel with the pressurizing cylinder and drivingly connected to the free end of the lever, and a stationary check valve coupled between the pressurizing chamber and the pressure accumulating chamber for communicating the chambers with each other and for preventing liquid from flowing backward from the pressure accumulating chamber to the pressurizing chamber.

2. The sprayer according to claim 1, wherein the lever is made from plastic material having a high elasticity and is biased to a non-rotatable position by the high elasticity thereof.

3. The sprayer according to claim 2 wherein the lever is biased to an upper position by the high elasticity thereof.

4. The sprayer according to claim 3, wherein the piston has a free end which is coupled to the lever, the piston being kept at an upper position by the elasticity of the lever.

5. The sprayer according to claim 4, wherein the lever has an elongate hole therein, and the free end of the piston is loosely inserted into the elongate hole in the lever, the diameter of the piston at the free end thereof being larger than the minor axis of the elongate hole but smaller than the major axis of the elongate hole, and the major axis extending in the longitudinal direction of the lever.

6. The sprayer according to claim 3 wherein the lever comprises an integral elastic hinge portion defining the pivotal point and biasing the lever upward.

7. The sprayer according to claim 1, wherein the piston has a free end and the lever has an elongate hole therein, and the free end of the piston is loosely inserted into the elongate hole in the lever, the diameter of the piston at the free end thereof being larger than the minor axis of the elongate hole but smaller than the major axis of the elongate hole, and the major axis extending in the longitudinal direction of the lever.

* * * * *